US011534730B1

(12) United States Patent
Springer et al.

(10) Patent No.: US 11,534,730 B1
(45) Date of Patent: Dec. 27, 2022

(54) DISPENSE SEQUENCE FOR A BEVERAGE MIXTURE DISPENSING SYSTEM

(71) Applicant: Cana Technology, Inc., Redwood City, CA (US)

(72) Inventors: Gregory Allen Springer, Los Altos, CA (US); Matthew Ambauen, San Francisco, CA (US); Stephan Weidi Tai, San Francisco, CA (US); Dale Word, Chico, CA (US); Elijah S. Kashi, San Francisco, CA (US); Kristopher Bernardo Dos Santos, San Francisco, CA (US)

(73) Assignee: Cana Technology, Inc., Redwood City, CA (US)

( * ) Notice: Subject to any disclaimer, the term of this patent is extended or adjusted under 35 U.S.C. 154(b) by 0 days.

(21) Appl. No.: 17/549,670

(22) Filed: Dec. 13, 2021

(51) Int. Cl.

| | |
|---|---|
| ***B67D 1/00*** | (2006.01) |
| ***B01F 33/84*** | (2022.01) |
| ***B01F 35/10*** | (2022.01) |
| ***B01F 23/236*** | (2022.01) |

(Continued)

(52) U.S. Cl.
CPC ..... *B01F 33/846* (2022.01); *B01F 23/236* (2022.01); *B01F 35/146* (2022.01); *B01F 35/1452* (2022.01); *B01F 35/71805* (2022.01); *B67D 1/0034* (2013.01); *B67D 1/0041* (2013.01); *B67D 1/0052* (2013.01); *B67D 1/0057* (2013.01); *B01F 2101/16* (2022.01); *B01F 2215/0431* (2013.01)

(58) Field of Classification Search
CPC ..... B67D 1/0034
USPC ..... 222/132, 145.5
See application file for complete search history.

(56) References Cited

U.S. PATENT DOCUMENTS 3,251,508 A * 5/1966 Borys ..... C10C 3/005 239/428
4,753,370 A * 6/1988 Rudick ..... B67D 1/0051 222/105

(Continued)

FOREIGN PATENT DOCUMENTS

DE 3430953 C2 8/1990
DE 10200805599484 B2 9/2010

(Continued)

*Primary Examiner* — David L Sorkin
(74) *Attorney, Agent, or Firm* — Daylight Law, P.C.

(57) ABSTRACT

Dispensing sequences for beverage mixture dispensing systems are disclosed. A disclosed method for operating a beverage mixture dispensing system includes flowing a first solvent from a first reservoir to a mixing area of the beverage mixture dispensing system, dispensing concentrated ingredients into the mixing area to combine the first solvent from the first reservoir with the concentrated ingredients to form an intermediate mixture, flowing the intermediate mixture to a mixing chamber of the beverage mixture dispensing system, flowing a sweetening liquid from a second reservoir to the mixing chamber, without flowing the sweetening liquid through the mixing area, to combine the sweetening liquid from the second reservoir with the intermediate mixture to form a beverage, and dispensing the beverage from the mixing chamber. A disclosed device is configured to execute this method. A disclosed computer-readable medium includes instructions for a device to execute this method.

20 Claims, 6 Drawing Sheets

(51) Int. Cl.
*B01F 35/71* (2022.01)
*B01F 101/16* (2022.01)

(56) References Cited

U.S. PATENT DOCUMENTS

| | | | | |
|---|---|---|---|---|
| 7,905,373 | B2 * | 3/2011 | Beavis | B67D 1/104 318/696 |
| 8,087,347 | B2 | 1/2012 | Halliday et al. | |
| 8,322,570 | B2 * | 12/2012 | Beavis | B67D 7/14 222/145.5 |
| 8,584,900 | B2 | 11/2013 | Metropulos et al. | |
| 8,960,500 | B2 | 2/2015 | Opstal et al. | |
| 10,501,304 | B2 | 12/2019 | Jangbarwala et al. | |
| 2007/0205221 | A1 * | 9/2007 | Carpenter | B67D 1/0888 222/145.6 |
| 2007/0278247 | A1 * | 12/2007 | Banks | B05B 7/2497 222/137 |
| 2011/0297272 | A1 * | 12/2011 | Hammonds | A23G 9/281 222/129 |
| 2013/0292407 | A1 * | 11/2013 | Beavis | F04B 49/065 222/23 |
| 2014/0144928 | A1 * | 5/2014 | Dobbins | B67D 1/108 222/142 |
| 2014/0372233 | A1 | 12/2014 | Knecht et al. | |
| 2016/0297663 | A1 | 10/2016 | Zemko | |
| 2017/0081168 | A1 | 3/2017 | Seay et al. | |
| 2017/0183214 | A1 | 6/2017 | Hecht et al. | |
| 2017/0225936 | A1 | 8/2017 | Jersey et al. | |
| 2017/0347830 | A1 | 12/2017 | Standaar et al. | |
| 2020/0087132 | A1 | 3/2020 | Moore et al. | |

FOREIGN PATENT DOCUMENTS

| | | | |
|---|---|---|---|
| EP | 0479113 | A1 | 4/1992 |
| WO | 2004030435 | A9 | 7/2004 |
| WO | 2015022692 | A3 | 6/2015 |
| WO | 2020219385 | A1 | 10/2020 |

* cited by examiner

500

DISPENSE SEQUENCE FOR A BEVERAGE MIXTURE DISPENSING SYSTEM

BACKGROUND

Beverage mixture dispensing systems mix various components, such as carbonated water and flavored syrups, to create and dispense beverages. Certain beverage mixture dispensing systems are configured to make a variety of beverages using different flavors components that should not carryover from one dispensed beverage to the next. Accordingly, these systems are designed to provide different fluid paths for different flavor components or are designed such that the areas in which different flavor components are mixed are configured to minimize carry over. An example of the first type of approach is a traditional soda fountain in which different flavored sodas are mixed along different fluid paths and dispensed from different dispensers that are presented in a row to the user. Examples of the second type of approach include beverage mixture dispensing systems with combined mixing-and-dispensing nozzles which have hydrophobic surfaces that do not retain flavor residue or that mix the different flavor components "in air" from different source fluid paths as they are being dispensed.

SUMMARY

Dispensing sequences and associated beverage mixture dispensing systems are disclosed. The dispensing sequences can be used by beverage mixture dispensing systems that mix various components to form a beverage. For example, the systems can include one or more solvent ingredients and one or more concentrated ingredients that are mixed to form a beverage. The various components can be dispensed through the system using a combination of shared fluid paths, separate fluid paths, and specific dispensing sequences to prevent carryover from one beverage to the next. The separate fluid paths can be used to prevent components with a high proclivity for carryover from being sent through shared fluid paths. The dispensing sequences can be used to assure that components with a high proclivity for carryover are only sent through a shared fluid path that has been prepared to prevent carryover, is treated afterwards to eliminate carryover, or both. As used in the remainder of this disclosure, the term "carryover component" refers to components with a high proclivity for carryover given the characteristics of the component and the surfaces it will contact as is dispensed.

In specific embodiments of the invention, a component of a beverage mixture dispensing systems is a shared component, such as a shared solvent, that is utilized by a series of beverages that the beverage mixture dispensing system is designed to make. As a basic example, the shared solvent is liquid water which is used as a solvent ingredient. In these embodiments, the shared component can be flowed through the shared fluid paths of the system without danger of carryover impacting a series of beverages because each beverage in the series uses the shared component. Additionally, in these embodiments, a shared component in the form of a shared solvent can be used to pretreat (e.g., coat) the shared paths to prevent absorption of carryover components by the surfaces of the shared paths. Additionally, in these embodiments, a shared component such as a shared solvent can be used to clean (e.g., rinse) the shared paths to remove carryover components from the surfaces of the shared paths.

In specific embodiments of the invention, a component of the beverage mixture dispensing system is a carryover component that is dispensed via a separate fluid path that is routed through the system to avoid one or more shared fluid paths of the device. In specific embodiments of the invention, the carryover component is not only a carryover component but additionally has a proclivity to lead to jamming or clogging of sensitive shared fluid paths. For example, the component could be a sweetening liquid with a high viscosity that tends to flow more slowly through the system and leave behind a thick sticky residue on surfaces it contacts. In these embodiments, the beverage mixture dispensing system could be designed to pretreat or clean any shared fluid path surfaces the carryover component meets as it is flowed through the system. In these embodiments, the beverage mixture dispensing system could additionally or in the alternative route the carryover component around one or more shared fluid paths entirely. For example, if a beverage mixture dispensing system included a shared fluid path in the form of a mixing area with small dimensions (e.g., mixing channels with widths of less than 15 millimeters or dispensing orifices with diameters of less than 5 millimeters) then the carryover component could be routed around the mixing area and mix downstream of the mixing channels. As used with reference to beverage mixture dispensing systems in this disclosure the terms "downstream" and "upstream" refer to a dispensing flow from an "upstream" storage location of a component "downstream" to where a beverage is dispensed from the system.

In specific embodiments of the invention, a component of the beverage mixture dispensing system is a component of the beverages made by the system and can alternatively have a cleansing or sanitizing effect. For example, the component could be an alcoholic solvent to be used as a sanitizer. The alcoholic solvent could have a high concentration (e.g., 80% or higher alcohol by volume (ABV)) such that it can be used for sanitizing surfaces. As another example, the component could be liquid water and be used to clean surfaces of the device through a rinsing process in which the liquid water was agitated across the surfaces. As another example, both liquid water and an alcoholic solvent could be used at different times to clean different surfaces. In specific embodiments, the solvent could be used for its sanitizing effect or cleaning effects and be sent through shared fluid paths to sanitize or clean the fluid paths. In embodiments in which the beverage mixture dispensing system includes both a shared solvent, and a sanitizing solvent which was not a shared solvent, the shared solvent could be used to pretreat and rinse the shared fluid paths before and after the sanitizing solvent was sent through the shared fluid paths.

In specific embodiments of the invention, a component of the beverage mixture dispensing system is a liquid solvent with which another component has been combined and for which routing through tight and/or circuitous fluid paths would result in a decrease in concentration of that other component in the liquid solvent. For example, the liquid solvent could be liquid water and the other component could be carbon dioxide which has been injected into the liquid water to form carbonated water. In these embodiments, the liquid solvent could be routed around any shared fluid paths in the system to prevent a decrease in concentration of the component prior to being mixed into a final beverage.

In specific embodiments of the invention, a method for operating a beverage mixture dispensing system is provided. The method comprises flowing a first solvent from a first reservoir to a mixing area of the beverage mixture dispensing system, dispensing concentrated ingredients into the mixing area to combine the first solvent from the first reservoir with the concentrated ingredients to form an intermediate mixture, flowing the intermediate mixture to a mixing chamber of the beverage mixture dispensing system, flowing a sweetening liquid from a second reservoir to the mixing chamber, without flowing the sweetening liquid through the mixing area, to combine the sweetening liquid from the second reservoir with the intermediate mixture to form a beverage, and dispensing the beverage from the mixing chamber.

In specific embodiments of the invention, a beverage mixture dispensing system is provided. The system comprises a first reservoir containing a first solvent, a set of at least two concentrated ingredient reservoirs, a mixing area fluidly connected to the first reservoir and the set of at least two ingredient reservoirs, a mixing chamber fluidly connected to the mixing area and having an outlet, and a controller. The controller stores instructions which, when executed by the controller, cause the beverage mixture dispensing system to flow a first solvent from a first reservoir to a mixing area of the beverage mixture dispensing system, dispense concentrated ingredients into the mixing area to combine the first solvent from the first reservoir with the concentrated ingredients to form an intermediate mixture, flow the intermediate mixture to a mixing chamber of the beverage mixture dispensing system, flow a sweetening liquid from a second reservoir to the mixing chamber, without flowing the sweetening liquid through the mixing area, to combine the sweetening liquid from the second reservoir with the intermediate mixture to form a beverage, and to dispense the beverage from the mixing chamber.

In specific embodiments of the invention, a beverage mixture dispensing system is provided. The system comprises a first reservoir and a first pump for flowing a first solvent from the first reservoir to a mixing area of the beverage mixture dispensing system, a set of at least two ingredient reservoirs configured to dispense concentrated ingredients into the mixing area to combine the first solvent from the first reservoir with the concentrated ingredients to form an intermediate mixture, a mixing chamber configured to receive the intermediate mixture from the mixing area, a second reservoir and a second pump for flowing a sweetening liquid from the second reservoir to the mixing chamber, without flowing the sweetening liquid through the mixing area, to combine the sweetening liquid from the second reservoir with the intermediate mixture to form a beverage, and a dispenser of the mixing chamber to dispense the beverage from the mixing chamber.

BRIEF DESCRIPTION OF THE DRAWINGS

In the figures, like reference numbers correspond to like components unless otherwise stated.

DETAILED DESCRIPTION

Figure 1A:
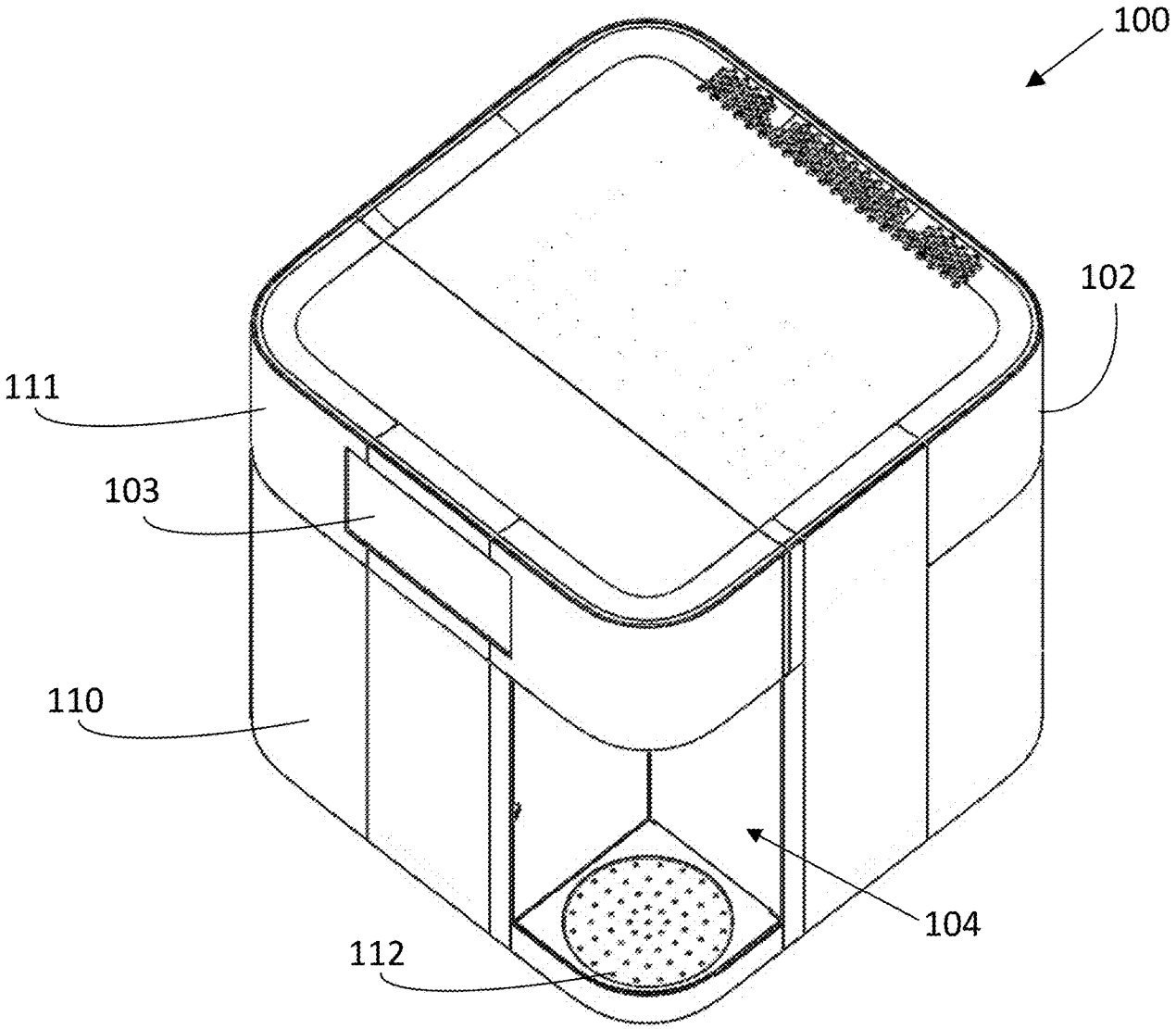
FIG. 1A illustrates a beverage mixture dispensing system in accordance with specific embodiments of the invention disclosed herein.

Reference will now be made in detail to implementations and embodiments of various aspects and variations of systems and methods described herein. Although several exemplary variations of the systems and methods are described herein, other variations of the systems and methods may include aspects of the systems and methods described herein combined in any suitable manner having combinations of all or some of the aspects described.

Dispensing sequences for beverage mixture dispensing systems are disclosed in detail in this disclosure. The methods and systems disclosed in this section are nonlimiting embodiments of the invention, are provided for explanatory purposes only, and should not be used to constrict the full scope of the invention. It is to be understood that the disclosed embodiments may or may not overlap with each other. Thus, part of one embodiment, or specific embodiments thereof, may or may not fall within the ambit of another, or specific embodiments thereof, and vice versa. Different embodiments from different aspects may be combined or practiced separately. Many different combinations and sub-combinations of the representative embodiments shown within the broad framework of this invention, that may be apparent to those skilled in the art but not explicitly shown or described, should not be construed as precluded.

Beverage mixture dispensing systems in accordance with specific embodiments disclosed herein can include one or more component reservoirs such as one or more solvent reservoirs and one or more concentrated ingredient reservoirs. The beverage mixture dispensing systems can be designed to mix various beverages using various sets of components selected from those available to the device. The beverage mixture dispensing systems can also include one or more mixing areas. The solvent reservoirs can contain solvents such as water, alcohol (e.g., ethanol or isopropanol), and other solvents. The reservoirs can also include high-volume concentrated ingredient components such as a sweetening liquid. The sweetening liquid can be an artificial sweetener (aspartame, saccharin, sucralose, acesulfame K, etc.) or natural sweetener (e.g., glucose, fructose, sucrose, etc.) dissolved in a solvent such as liquid water. The reservoirs can be standalone cartridges filed with the components and attached to the beverage mixture dispensing system or an external source of the component which is connected to a socket on the device (e.g., a faucet or other external solvent supply source). The components can be shared components which are used by a series of separate beverages that are made by the beverage mixture dispensing system. Alternatively, the components can be less common components which are not shared by a series of beverages that are made on the device, and which should not carryover from one beverage to the next. The concentrated ingredient reservoirs can contain concentrated ingredients that are meant to be combined with the solvents from the solvent reservoirs to make a beverage. The mixing areas can be areas in which solvents from the solvent reservoirs are combined with ingredients from the ingredient reservoirs. For example, a mixing area could be a chamber into which one or more concentrated ingredients from the concentrated ingredient reservoirs and one or more solvents from the solvent reservoirs are combined. As another example, the mixing area could be a set of channels into which one or more ingredients from the ingredient reservoirs are dispensed into the one or more solvents as the solvents flow through, or rest within, the set of channels.

In specific embodiments of the invention, a beverage mixture dispensing system can include one or more mixing chambers in addition to the mixing area. The mixing chamber can include a basin, one or more inlets, and a sealable outlet. The sealable outlet can be part of a dispenser for the beverage. The mixing chamber can be designed to actively or passively mix the contents of the mixing chamber. For example, the components could be passively mixed as they are poured into the chamber and diffused together, or actively via the application of an agitating force to the contents of the mixing chamber. The mixing chamber can be connected downstream of the mixing area such that it receives a mixture from the mixing area and then conducts further mixing before the beverage is dispensed from the device. Solvents and other liquids from the solvent reservoirs and other reservoirs can be dispensed into the mixing chamber directly, without moving through the mixing area, or can be indirectly dispensed into the mixing chamber by first flowing through the mixing area. Such solvents and other liquids can be flowed through dedicated fluid lines from their reservoirs to the mixing chamber. Alternatively, or in combination, solvents can flow through shared fluid lines from the reservoirs to the mixing area and/or mixing chamber.

FIG. 1A illustrates an example of a beverage mixture dispensing device 100, in accordance with specific embodiments disclosed herein. The beverage mixture dispensing device 100 can be the fluid mixture dispensing device described in U.S. Provisional Patent Application No. 63/146,461 filed Feb. 5, 2021, which is incorporated by reference herein in its entirety for all purposes.

The beverage dispensing device 100 can include a casing, such as casing 102, that can house various internal components of the device. The casing 102 can include various accesses to the interior of the device. The accesses can be in the form of doors, such as upper access door 111 and lower access door 110. The accesses can also be removable portions, such as lids or walls of the casing. The accesses can be configured so that a user of the device can access at least part of the interior of the device, for example to replace a component, to clean the device, etc., as will be described below in more detail.

The beverage dispensing device can also include a user interface, such as user interface 103. The user interface 103 can include any means for outputting information from the device to a user of the device, and for inputting information from the user of the device to the device. In this way, the user interface can include any means that facilitate the interaction of a user of the device with the device, including but not limited to a display, a speaker, a microphone, a camera, various sensors such as light and presence sensors, etc. For example, the user interface can include a touch screen display, so that the device can display information for the user via the display, and the user can provide inputs to the device via the touch screen display. As another example, the interaction between the user and the device can be via auditory cues provided by the device via a speaker and voice commands from the user received via a microphone. As another example, the device can recognize user facial expressions and gestures via cameras and sensors. The user interface components can be associated to a controller of the device so that the controller can administrate the information to be outputted and process the information being received.

The beverage dispensing device 100 can also include a dispense area, such as dispense area 104. Dispense area 104 can be the area where a beverage is dispensed out of the device 100. Dispense area 104 can be an area configured to receive a vessel or other containers to dispense a beverage out of device 100. The dispense area 104 can be sized so that different containers (for example a wine glass) can be placed therein. In specific embodiments of the invention, the dispense area 104 can be adjusted, for example by using a height adjustable tray. The dispense area 104 can include a waste outlet, such as waste outlet 112. The waste outlet can be a removable waste outlet, such as a removable drip tray.

Figure 1B:
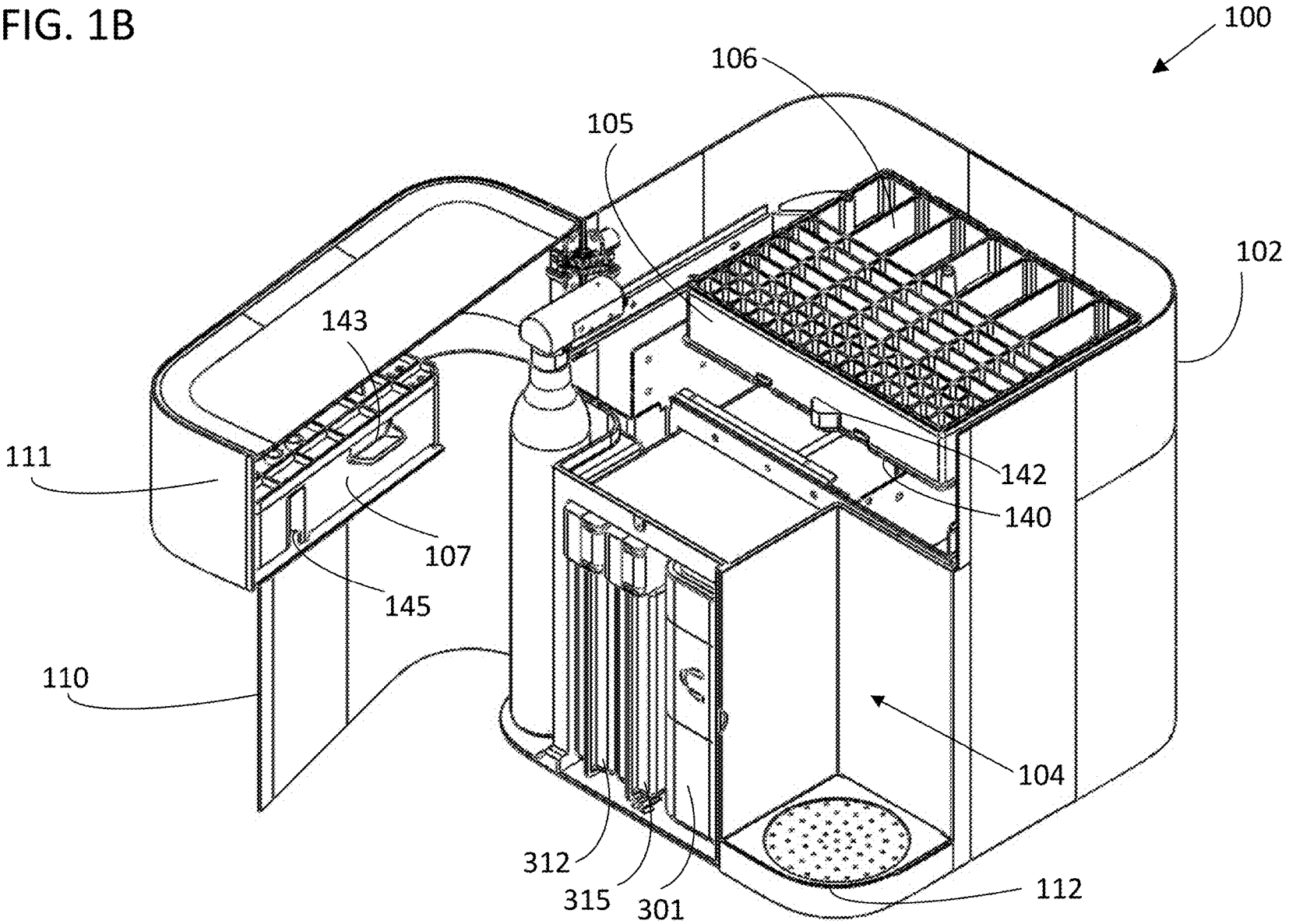
FIG. 1B illustrates interior features of a beverage mixture dispensing system in accordance with specific embodiments of the invention disclosed herein.

FIG. 1B illustrates the beverage dispensing device 100 of FIG. 1A in an open configuration to illustrate exemplary internal components that can be housed by the casing 102 of the beverage dispensing device 100, in accordance with specific embodiments disclosed herein. The accesses, such as upper access door 111 and the lower access door 110, are open in this figure. The doors can be attached to the remaining of the casing via hinges or other structure. The doors can alternatively be removable doors so that they are completely removed when open. The doors can be any kind of doors such as sliding doors, and open in any direction, for example to the top or to the right of the device. Doors 111 and 110 can be separate doors or a unitary door of the device. In this example, the access doors have been represented in the front wall of the device. However, this is not a limitation of the invention. Different doors and/or any access to the interior of the device can be located anywhere on the device, and do not need to be located on the front wall. In the example of FIG. 1B, a portion of the top wall of the device 100 has been removed to expose some additional exemplary components of the device.

The beverage dispensing device 100 can include one or more ingredient reservoirs, such as ingredient reservoir 106. The ingredient reservoirs can store ingredients to be used by the beverage dispensing device 100 to create a beverage, such as concentrated liquids (e.g., flavor syrups, salts, acids, etc.) The ingredient reservoirs can be any of the ingredient reservoirs described in U.S. patent application Ser. No. 17/545,699 filed Dec. 8, 2021, which is incorporated by reference herein in its entirety for all purposes.

The ingredient reservoirs, such as ingredient reservoir 106, can be located in a cartridge, such as cartridge 105. The cartridge can be accessed via one of the accesses of the device. For example, the cartridge can be accessed through upper access door 111. In this way, a user of the device can replace the cartridge as needed. In the example of FIG. 1B, the top surface of cartridge 105 has been removed to expose the ingredient reservoirs 106. However, the cartridge can be completely encased. In specific embodiments of the invention, the cartridge includes a removable lid so that the various ingredient reservoirs can be accessed, for example to be refilled. The cartridge can be any of the cartridges described in U.S. Provisional Patent Application No. 63/146,461 filed Feb. 5, 2021, U.S. patent application Ser. No. 17/547,081 filed Dec. 9, 2021, U.S. patent application Ser. No. 17/547,612 filed Dec. 10, 2021, and U.S. patent application Ser. No. 17/545,699 filed Dec. 8, 2021, all of which are incorporated by reference herein in their entirety for all purposes.

The beverage dispensing device 100 can also include one or more high volume reservoirs, such as first reservoir 301, second reservoir 312, and third reservoir 315. The solvent reservoirs can store solvents to be used by the beverage dispensing device 100 to create a beverage, such as water, alcohol, etc. The solvent reservoirs can be any of the solvent reservoirs described in U.S. Provisional Patent Application No. 63/146,461 filed Feb. 5, 2021 and U.S. patent application Ser. No. 17/547,081 filed Dec. 9, 2021, all of which are incorporated by reference herein in their entirety for all purposes. The solvent reservoirs can be accessed via one of the accesses of the device. For example, the solvent reservoirs can be accessed through lower access door 110. In this way, a user of the device can remove the solvent reservoirs as needed, for example to refill a water tank.

The beverage dispensing device 100 can be configured to create a beverage by mixing one or more components from one or more concentrated ingredient reservoirs 106 and/or one or more reservoirs 301, 312, 315. A controller of the system can have knowledge of the amount of each compound needed for a given recipe and cause the device to dispense the required amount of concentrated ingredients and/or solvent to a mixing area of the device. The mixing area can be formed on a bottom plate, such as plate 140, of the ingredient cartridge. Ingredients from the ingredient reservoirs 106 and solvent from the solvent reservoirs 108 can flow from the respective reservoirs to the mixing area of the device 100. In specific embodiments of the invention, the ingredients from the ingredient reservoirs 106 flow to the mixing area and solvent from the reservoirs flow though the mixing area to "collect" the ingredients dispensed therein. In specific embodiments of the invention, solvent from the reservoirs is allowed to enter the mixing area, and the concentrated ingredients from the concentrated ingredient reservoirs are dispensed from the reservoirs directly into the solvent already in the mixing area. In any case, an intermediate mixture of one or more concentrated ingredients and/or one or more solvent can be formed in the mixing area of the device.

The term "intermediate mixture" is used herein to refer to a mixture being created in the mixing area of the device (for example in one or more mixing channels formed on plate 140). FIG. 1B illustrates a fluid outlet 142 of the cartridge. Fluid outlet 142 can be connected to the mixing area and allow the intermediate mixture formed therein to flow out to a final dispense chamber 107. The final dispense chamber can be any of the final dispense chambers described in U.S. Provisional Patent Application No. 63/146,461 filed Feb. 5, 2021, and U.S. patent application Ser. No. 17/548,318 filed Dec. 10, 2021, all of which are incorporated by reference herein in their entirety for all purposes. The final dispense chamber of FIG. 1B is an example of the mixing chambers disclosed herein.

When the access door 111 is closed, the final dispense chamber 107 can be connected to the fluid outlet 142 of the cartridge via the fluid inlet 143. Once in the final dispense chamber 107, the intermediate mixture can be turned into the final beverage to be dispensed by the device 100. In specific embodiments of the invention, the final beverage is the intermediate mixture itself, as received from the mixing area. Alternatively, or in combination, the intermediate mixture can be further mixed with other ingredients (for example sugar water, carbonated water, etc.) in the final dispense chamber to create the final beverage. Alternatively, or in combination, the intermediate mixture can be submitted to other processes such as further mixing, temperature adjustments, carbonation, etc. in the final dispense chamber 107 to create the final beverage. The final beverage can then be dispensed out of the final dispense chamber 107 and to the dispense area 104 via a dispenser, such as dispenser 145.

In specific embodiments of the invention, the beverage dispensing device can be configured to automatically dispense beverages. For example, the beverage dispensing device 100 can be configured to allow the beverage to be poured out of the final dispense chamber 107, for example by unlocking the dispenser 145.

Figure 2:
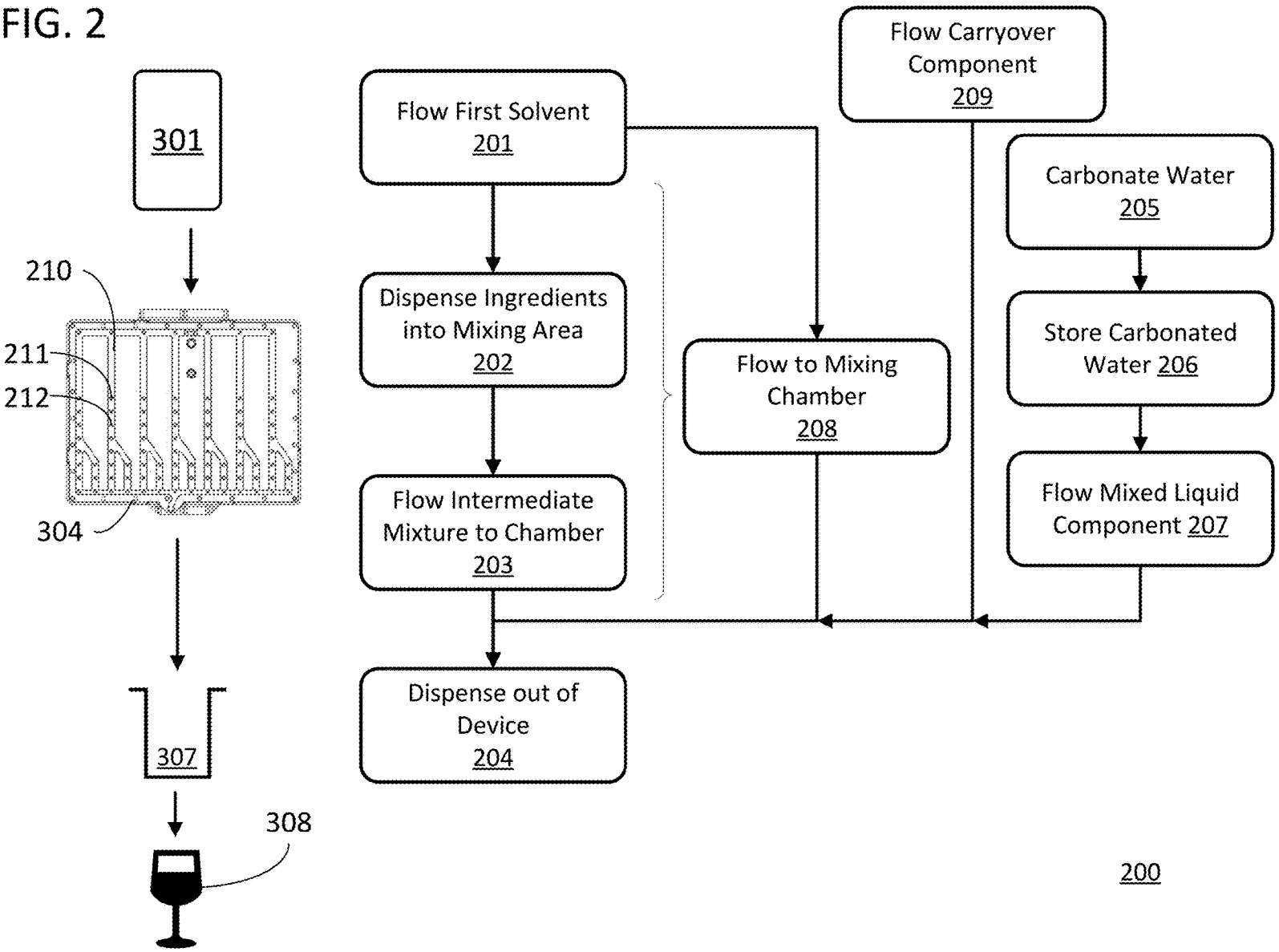
FIG. 2 illustrates a flow chart for a set of methods using dedicated solvent lines and a pretreatment of a mixing chamber in accordance with specific embodiments of the invention disclosed herein.
Figure 3:
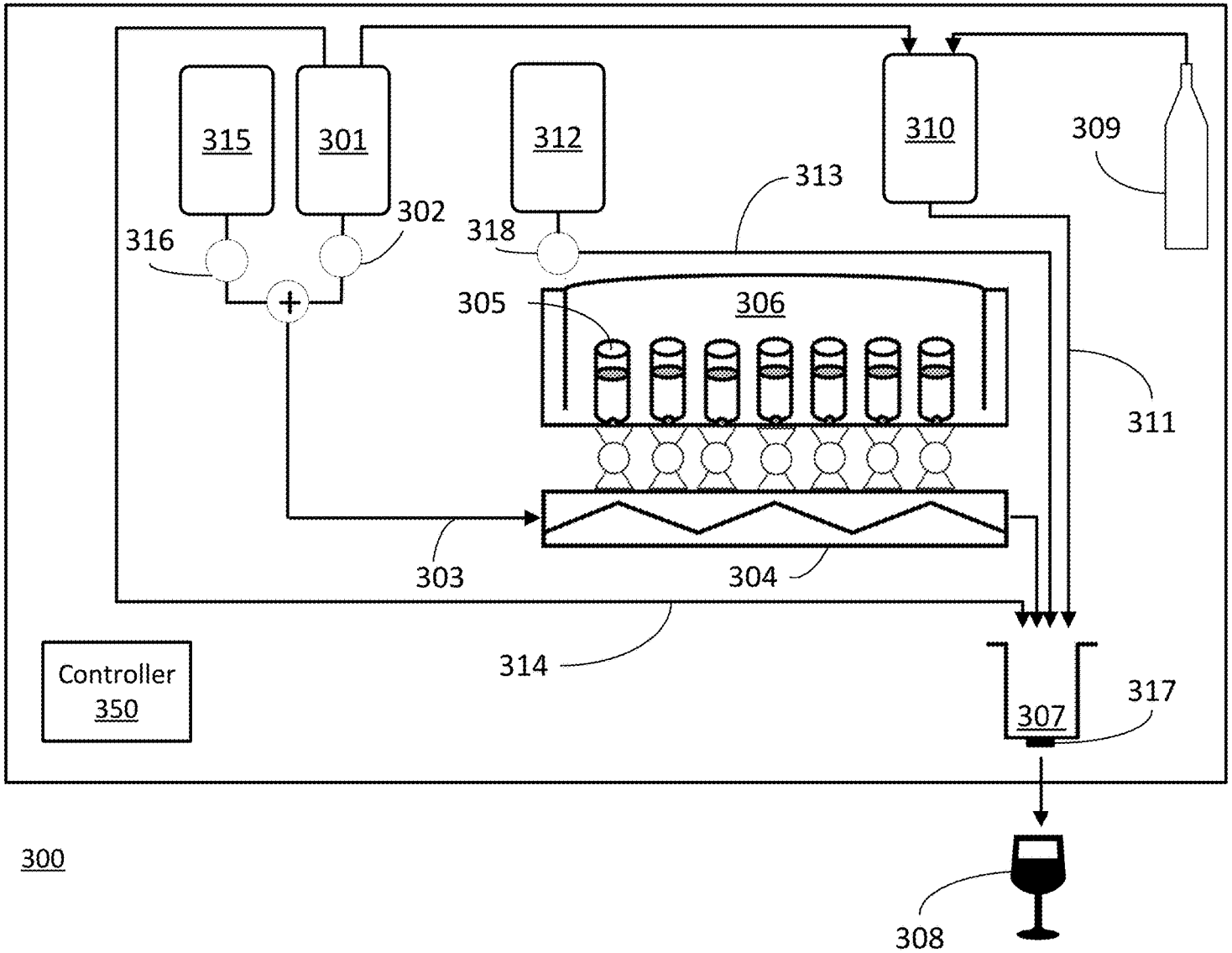
FIG. 3 illustrates a block diagram of a set of fluid paths for beverage mixture dispensing system in accordance with specific embodiments of the invention disclosed herein.
Figure 4:
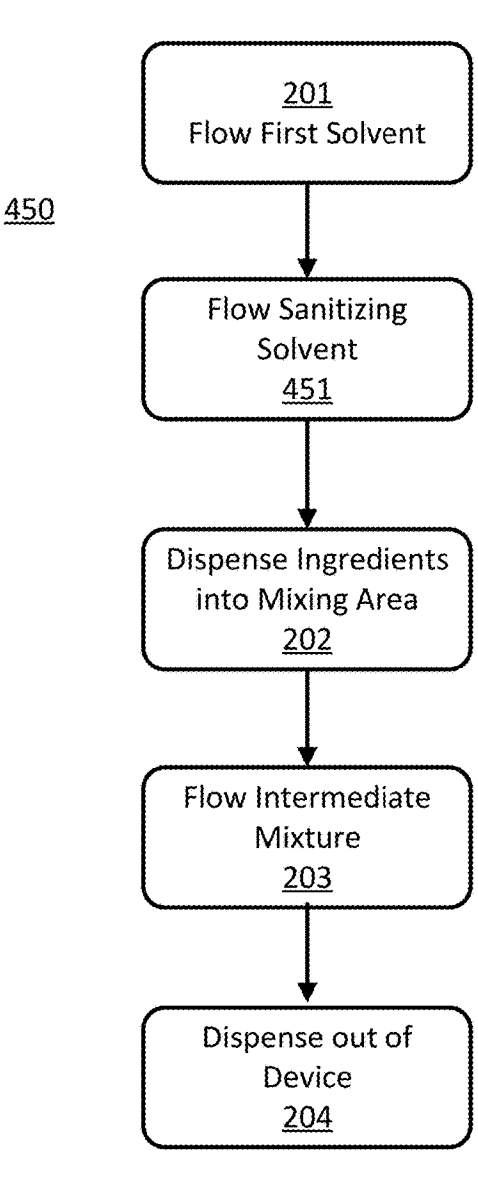
FIG. 4 illustrates a flow chart for a set of methods using a shared solvent line and a flow chart for a set of methods using a sanitizing fluid in accordance with specific embodiments of the invention disclosed herein.
Figure 4:
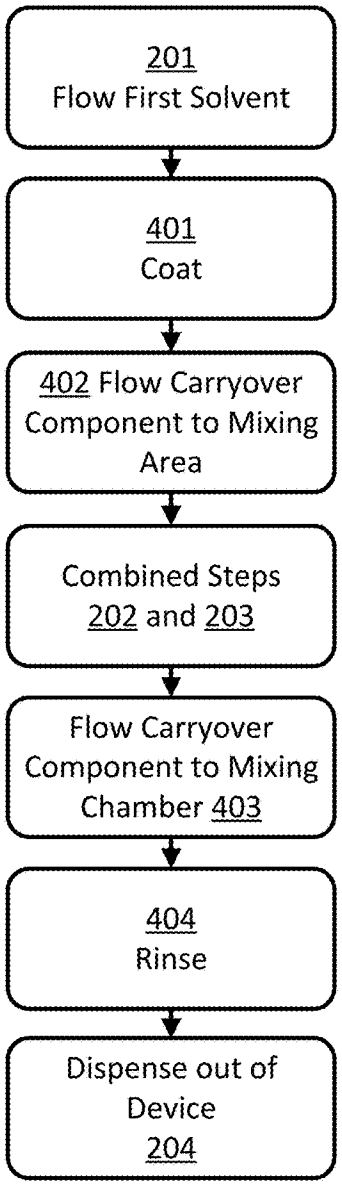
Figure 5:
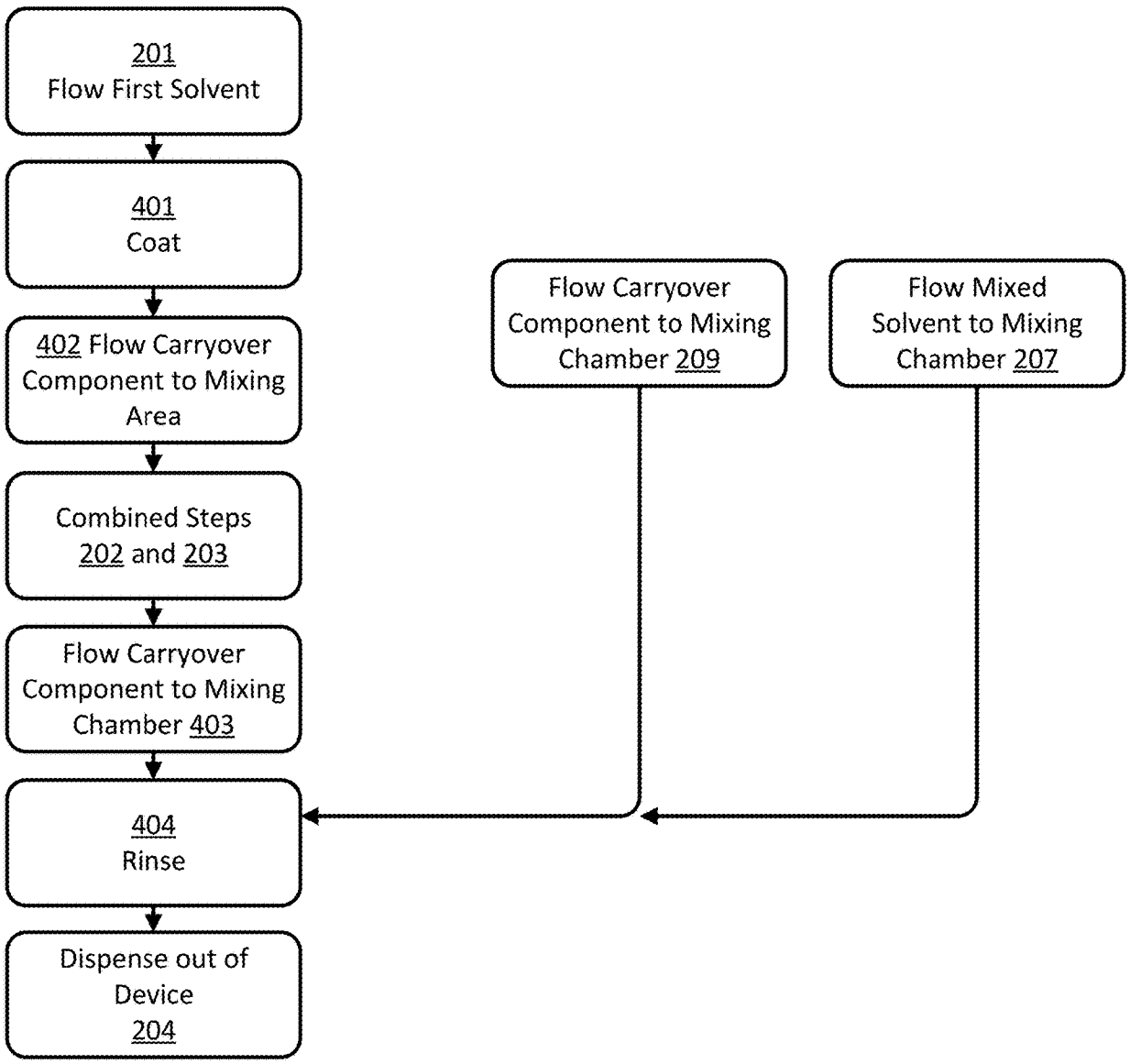
FIG. 5 illustrates a flow chart for a set of methods that utilize a combination of steps from the methods in FIG. 2 and FIG. 4.

Sequencing methods for devices such as the ones described above with reference to FIGS. 1A and 1B are described below with reference to FIGS. 2-5. However, while the methods can be used with such devices, they are more broadly applicable to any beverage mixture dispensing system. FIGS. 2, 4, and 5 include flow charts for a set of methods for operating a beverage mixture dispensing system such as a beverage mixture dispensing system having a set of fluid paths in accordance with the block diagram of FIG. 3. The beverage mixture dispensing devices disclosed herein can include controllers, such as controller 350 in FIG. 3, which are configured to execute the steps of the methods and dispense sequence described herein by sending control signals to and receiving information signals from various pumps, valves, pneumatic systems, sensors, actuators, and other devices that can be utilized to mix a beverage and monitor the mixing process. The controller can include one or more processors and can have access to a computer readable medium storing instructions which, when executed by the one or more processors, cause the beverage mixture dispensing system to operate in accordance with the methods disclosed herein.

The methods of FIGS. 2, 4, and 5 all include a step 201 of flowing a first solvent from a first reservoir to a mixing area of the beverage mixture dispensing system. The mixing area could be an area in which concentrated ingredients are mixed with solvents. The first solvent could be a shared solvent, such as liquid water, which is used by a series of beverages that are mixed and dispensed by the beverage mixture dispensing system. Alternatively, the first solvent could be a solvent which is not a shared solvent and the fact that it is dispensed into the mixing area may create an opportunity for some of the approaches disclosed herein as the mixing area generally includes shared surfaces such that flowing solvents which are not shared solvents can create the possibility of carryover. The first reservoir could be first reservoir 301 in block diagram 300 which is dispensed using a pump 302 through a shared solvent line 303 to a mixing area 304. In the example of block diagram 300, mixing area 304 is a set of mixing channels into which concentrated ingredients are dispensed from concentrated ingredient reservoirs 305 in a cartridge 306.

The methods of FIGS. 2, 4, and 5 all include a step 202 of dispensing concentrated ingredients into the mixing area to combine the first solvent from the first reservoir with the concentrated ingredients to form an intermediate mixture. The mixing area can have the characteristics of any of the mixing areas described above. The concentrated ingredients can be stored in ingredient reservoirs and be dispensed according to any of the approaches disclosed above. In specific embodiments of the invention, the concentrated ingredients are dispensed into the mixing area after the mixing area has been coated with the shared solvent or while the mixing area is full of the shared solvent to prevent carryover from concentrated ingredients contacting the shared surfaces of the mixing area. For example, a shared solvent in the form of liquid water can fill the channels (e.g., channel 210) of mixing area 304 at the time the concentrated ingredients are dispensed to avoid undissolved concentrated ingredients from contacting the channels (e.g., channel 210) as each channel is shared by multiple ingredients dispensed from various orifices (e.g., first orifice 211 and second orifice 212 dispense into channel 210). In these embodiments, the fact that the ingredients are dispensed into the solvent therefore limits the potential for carryover from one beverage to the next.

The methods of FIGS. 2, 4, and 5 all include a step 203 of flowing the intermediate mixture to a mixing chamber of the beverage mixture dispensing system. The mixing chamber can have the characteristics of any of the mixing chambers described above. For example, the mixing chamber can include a basin 307, an inlet for receiving the intermediate mixture, and a sealable outlet to prevent the dispensing of the beverage out of the device until the beverage has been finalized in the basin. The sealable outlet can be a dispenser 317 of the beverage mixing dispensing system. The intermediate mixture can be a mixture of one or more solvents and one or more concentrated ingredients as described above. In specific embodiments of the invention, step 203 can be conducted simultaneously with step 202, meaning that the concentrated ingredients are dispensed while the solvent and dissolved concentrated ingredients are simultaneously being dispensed into the mixing chamber. However, in alternative embodiments, step 202 can be conducted while the solvent is stationary in the mixing area, and step 203 can commence after the concentrated ingredients have been dispensed into the mixing area. In specific embodiments of the invention, the intermediate mixture is used to coat the mixing chamber prior to the introduction of a carryover component to the mixing chamber. However, in alternative embodiments, the mixing chamber is pretreated with a shared solvent prior to the execution of step 203 because the intermediate mixture is itself a carryover component. A beverage mixture dispensing system can be designed to conduct both types of dispensing sequence based on the characteristics of the beverage it is currently making (e.g., it can pretreat the mixing chamber for one drink with a highly concentrated intermediate mixture, and then not pretreat the mixing chamber on the next drink).

The methods of FIGS. 2, 4, and 5 all include a step 204 of dispensing a beverage from the mixing chamber. The beverage can be dispensed from a mixing chamber into an exterior vessel. The mixing chamber can have the characteristics of any of the mixing chambers described above. For example, the beverage can be dispensed from a basin 307 into a glass 308. The beverage can be dispensed by opening a sealable outlet of the mixing chamber. For example, the beverage can be dispensed from basin 307 via a dispenser 317. In specific embodiments, the mixing chamber can be rinsed with an additional flow of a shared solvent while the beverage is being dispensed. For example, a sealable outlet of the mixing chamber can be kept open while additional solvent is flowed into the mixing chamber simultaneously with the beverage being dispensed from the mixing chamber. The flowing of the additional shared solvent can be timed according to a commensurate decrease in concentration of solutes in the contents of the mixing chamber such that the final amount of shared solvent added to the mixing chamber is added as the contents of the mixing chamber no longer constitute a carryover component. The additional solvent can be finally mixed into the beverage while being added into the mixing chamber and while falling into the exterior vessel.

In specific embodiments of the invention, a component of the beverage mixture dispensing system is a liquid solvent with which another component has been combined, to form a mixed liquid component, and for which routing through numerous narrow fluid paths would result in a decrease in concentration of that other component in the liquid solvent. For example, the liquid solvent could be liquid water from a first reservoir 301 and the other component could be carbon dioxide from a carbon dioxide tank 309 which has been injected into the liquid water to form carbonated water in a carbonated water reservoir 310.

In specific embodiments, in which a beverage mixture dispensing system includes a mixed liquid component in accordance with the prior paragraph, the mixed liquid component could be routed around any circuitous or narrow fluid paths in the system to prevent a decrease in concentration of the component prior to being mixed into a final beverage. The routing of the component could be around circuitous or narrow fluid paths such as the channels of a mixing area (e.g., channel 210) illustrated in FIG. 2. Mixing area 304 in FIG. 2 could be above plate 140 of cartridge 105 in FIG. 1B and could present a fluid path which would greatly decrease a level of carbonization in a carbonized solvent send through the fluid path. As illustrated in FIG. 2, the method could include a step 205 of carbonating water from the first reservoir, a step 206 of storing the carbonated water in a carbonated water reservoir (e.g., carbonated water reservoir 310), and a step 207 of flowing the carbonated water from the carbonated water reservoir to the mixing chamber, without flowing the carbonated water to the mixing area, to combine the carbonated water from the carbonated water reservoir with the intermediate mixture to form the beverage. For example, the carbonated water from carbonated water reservoir 310 could be routed using a dedicated carbonated water line 311 to basin 307. While the example of a liquid solvent with carbonation was provided as an example, the same approach could be used by any liquid solvent with a dissolved component whose concentration decreases if the solvent is physically manipulated through complex fluid flow paths.

In specific embodiments of the invention, in which a beverage mixture dispensing system includes a carryover component, the carryover component could be routed around any shared fluid paths to prevent carryover. However, a carryover component can be routed through a different path for different reasons. In particular, the carryover component could be routed to prevent carryover in shared fluid paths or to prevent jamming, clogging, or otherwise degrading the performance of the beverage mixture dispensing device. For example, the carryover component could be a sweetening liquid with a tendency to leave behind a sticky residue on any surfaces it is applied to. The path the component is routed around could be a mixing area with channels having dimensions of less than 20 millimeters and ingredient dispensing orifices having diameters of less than 5 millimeters in width making them susceptible to clogging. In the example of FIG. 2, flow chart 200 includes a step 209 of flowing a carryover component (e.g., a sweetening liquid) from a second reservoir to a mixing chamber, without flowing the carryover component through a mixing area, to combine the carryover component from the second reservoir with the intermediate mixture to form a beverage. The mixing area could include channels such as channel 210 with ingredient dispensing orifices (e.g., first orifice 211 and second orifice 212) having diameters of less than 5 millimeters. The carryover component could be dispensed from a carryover component reservoir (e.g., second reservoir 312) using a pump (e.g., pump 318) and a dedicated fluid line (e.g., dedicated sweetener line 313). As will be described below, the intermediate mixture does not necessarily need to be in the mixing chamber prior to the addition of the sweetener to the mixing chamber. In these situations, the sweetening liquid will still mix with the intermediate mixture in the mixing chamber to form a beverage before it is dispensed. However, coating the mixing chamber with the intermediate mixture or a solvent before dispensing the carryover component into the mixing chamber can provide certain benefits as described below.

In specific embodiments of the invention, a shared solvent is used to coat various surfaces of a beverage mixture dispensing devices before other components contact those surfaces. The surfaces could be the surfaces of a mixing area of the beverage mixture dispensing system or a downstream mixing chamber of the beverage mixture dispensing system. The mixing areas and mixing chambers can have any of the characteristics as those described above. The shared solvent can be used to coat the surfaces in its pure form or after it has been used to dissolve a solute so long as the concentration of solute or solutes in the shared solvent is not so high that the shared solvent has itself become a carryover solvent. For example, liquid water could be used to coat surfaces in the mixing area and mixing chamber, in its pure form or in the form of an intermediate mixture generated in the mixing area.

The shared solvent can be used to coat various surfaces at various times during the dispensing of a beverage from the device. In the example of flow chart 200, the shared solvent is dispensed into the mixing chamber in a step 208 prior to when the carryover solvent 209 is dispensed into the mixing chamber. This is done so that concentrated sweetening liquid is never in direct contact with the surfaces of the mixing chamber. Instead, the surfaces of the mixing chamber have been coated with the shared solvent prior to the dispensing of the sweetening liquid. As such, step 208 can include coating, before the flowing of the sweetening liquid from the second reservoir (e.g., second reservoir 312) to the mixing chamber, a portion of a basin (e.g., basin 307) of the mixing chamber with the first solvent from the first reservoir (e.g., liquid water from reservoir 301). In the example of block diagram 300, this step can be conducted via a dedicated water bypass line 314 or through flowing water through shared solvent line 303, on through mixing area 304, and into basin 307.

As illustrated in FIG. 2, the flow of shared solvent to the mixing chamber can be conducted at various times relative to the dispensing of the ingredients into the mixing area and the flowing of the intermediate mixture to the chamber. The shared solvent can be used to coat the mixing chamber prior to the dispensing of ingredients to the mixing area. If the water is sent through shared solvent line 303 and mixing area 304, it can be flowed through to basin 307 before ingredients are dispensed from cartridge 306 into mixing chamber 304, or after the ingredients are dispensed. Furthermore, the shared solvent can also be used to coat the surfaces of the mixing area on its way through to the mixing chamber which will have the added benefit of preventing carryover from the dispensing of concentrated ingredients into the mixing area. The shared solvent can also be used to coat the mixing chamber after the dispensing of ingredients to the mixing area. This approach can be conducted using the dedicated solvent line (e.g., dedicated water bypass line 314) or through the mixing area (e.g., mixing area 304). In the second example, if the shared solvent is not used to coat the mixing chamber until after the ingredients are dispensed, the shared solvent may be in the form of an intermediate mixture when it is used to coat basin 307. However, this will not be a problem so long as the concentration of the intermediate mixture is not so high that it has itself become a carryover component. The beverage mixture dispensing system can be programmed to sequence these steps in different ways according to the characteristics of the beverage being made. For example, if the beverage mixture dispensing system is being used to make a sugary cocktail, where the intermediate mixture may have a high concentration of flavor compounds added, the device may use pure liquid water to coat the mixing chamber before the ingredients are dispensed where the same device may skip such a step if the intermediate mixture has a lower concentration of flavor compounds.

In specific embodiments of the invention, the dispensing of any carryover solvents into a mixing chamber can be conducted in relation to when and how the mixing chamber was coated with shared solvent. For example, the shared solvent could coat a portion of a mixing chamber, and the carryover solvent could be dispensed in such a way as to only come in contact with that portion of the mixing chamber. In such case, step 208 could include coating, before the flowing of a carryover component (e.g., sweetening liquid) in step 209 from a reservoir (e.g., second reservoir 312) to the mixing chamber, a portion of a basin (e.g., basin 307) of the mixing chamber with the shared solvent (e.g., water from reservoir 301). In keeping with this example, the flowing of the carryover component (e.g., sweetening liquid) from the reservoir to the mixing chamber in a step 209 could be conducted such that the carryover component (e.g., sweetening liquid) only touches the basin at the portion of the basin. For example, step 209 could be conducted with a volume of liquid limited by, or coordinated with, an amount of liquid used to coat the mixing chamber. Alternatively, in situations in which the device can route beverage components to and/or through different portions of a mixing chamber, the flowing of a carryover component in step 209 could be conducted to only flow the carryover component through portions that had been prepared using a coating of shared solvent.

In specific embodiments of the invention, in the alternative or in addition to coating the shared surfaces of the beverage mixture dispensing system, a shared solvent can be used to rinse the shared surfaces of the beverage mixture dispensing system. The shared surfaces could be a mixing area or mixing chamber of the beverage mixture dispensing system. The mixing area or mixing chamber could be in accordance with those described above. The shared solvent could coat the surfaces prior to dispensing any carryover ingredients on the shared surfaces and/or rinse the same surface towards the end of the mixing process to clean the surfaces for the next step. For example, flow chart 400 in FIG. 4 includes an approach in which carryover components are dispensed to both the mixing area and the mixing chamber and the shared solvent is used to both coat and rinse the shared surfaces of both areas. However, in alternative approaches the shared solvent is only used to coat and/or rinse the shared surfaces of the mixing chamber or the mixing area.

Flow chart 400 includes many of the steps from flow chart 200. However, it also includes a step 401 of coating, before the flowing of a carryover component to the mixing area in a step 402, the mixing area of the device with a shared solvent such as the solvent dispensed in step 201. As described above, in specific embodiments of the invention a process that coats the mixing area can also coat the downstream mixing chamber. As such, step 401 can further include coating, before the flowing of a carryover component to the mixing chamber in a step 403, the mixing chamber with a shared solvent from the first reservoir. In either case, the carryover component that flows to the mixing area and/or mixing chamber could be an alcoholic solvent from another reservoir (e.g., third reservoir 315) which flows through a shared solvent line (e.g., shared solvent line 303).

In specific embodiments of the invention, the amount of shared solvent used for a coating step (such as coating step 401) and a rinsing step (such as rinsing step 404) is selected such that it is equal to or less than a volume of the beverage that will be dispensed from the beverage mixture dispensing system. The amount of shared solvent used for this purpose can be designed to be the amount of solvent required for the beverage to be dispensed. For example, the amount of a first solvent used in coating step 401 and rinsing step 404 can be set equal to a quantity of the first solvent in the beverage. Additionally, the amounts used in each step can be set to favor the rinsing step as compared to the coating step with more volume being used for rinsing than for coating.

As mentioned before, the beverage mixture dispensing system can be programmed to sequence these steps in different ways according to the characteristics of the beverage being made. For example, the volume of the beverage can be considered in determining if a rinsing or coating step is possible. For example, the device could put off a cleaning or rinsing step if it was not necessary to prevent carryover as when the beverage being made was a low volume beverage with the knowledge that a more intense rinsing operation could be conducted the next time a larger volume beverage was being mixed.

In specific embodiments of the invention, the beverage mixture dispensing system can include an alcoholic solvent. The alcoholic solvent can be both a carryover component and in combination or in the alternative be used as a sanitizing fluid. For example, the alcoholic solvent could have a high concentration (e.g., 80% of higher alcohol by volume (ABV)) such that it can be used for sanitizing surfaces, but if such a high concentration of alcohol was routed through a shared fluid channel, the alcohol would also constitute a carryover component. With reference to FIG. 4, this could mean that the carryover component that flows to the mixing area in step 402 could also be used as part of rinsing step 404. In specific embodiments of the invention in accordance with this example, the rinsing step 404 uses an alcoholic solvent followed by water as a final rinse. By using water as a final rinse and/or to coat the surface of the shared fluid channels that will receive the alcoholic solvent, carryover can be minimized. The rinsing step can also be conducted by a solvent that is not a carryover solvent which is dispensed directly to the mixing chamber such as the carbonated water from carbonated water reservoir 310 in FIG. 3.

In specific embodiments of the invention, an alcoholic solvent can be flowed at various times to sanitize various portions of the beverage mixture dispensing system. For example, the flowing of the alcoholic solvent could be conducted in between the flowing of a first solvent through a mixing area. In other words, the flowing of the first solvent from a reservoir could be conducted both before and after the flowing of the alcoholic solvent from another reservoir to the mixing area. Such an approach is in accordance with flow chart 400 in which the carryover component that flows to the mixing chamber in step 402 is an alcoholic solvent. These embodiments can also be used where the alcoholic solvent is not strong enough to sanitize surfaces but is still used to mix a beverage. As another example, flow chart 450 shows an example of an alcoholic solvent flowing to the mixing area as a sanitizing solvent in step 451 without the use of any coating or rinsing steps. These embodiments could include those in which the alcoholic solvent is dispensed through a separate dedicated line, in which the alcoholic solvent is not concentrated enough to be a carryover component, or in which the beverage mixture dispensing system dispenses a series of alcoholic beverages such that the alcoholic solvent is a shared solvent. In these embodiments, the alcoholic solvent could be ethanol and could be flowed from the third reservoir 315 via a pump 316 through shared solvent line 303 to mixing area 304. The alcoholic solvent could then sanitize mixing area 304. In specific embodiments of the invention, the alcoholic solvent is more effective at sanitizing surfaces if it is not preceded by a coating step with a separate solvent such as water.

FIG. 5 illustrates a flow chart 500 for a set of methods that utilize a combination of steps from the methods in FIG. 2 and FIG. 4. Flow chart 500 illustrates how the rinsing in step 404 can rinse both the carryover component which was dispensed to the mixing area (e.g., an alcoholic solvent) and a carryover component that was dispensed to mixing chamber in step 207 (e.g., a sweetener fluid). A specific implementation of the methods in flow chart 500 can be described with reference to the block diagram of FIG. 3. In step 201 a first solvent in the form of liquid water is flowed from first reservoir 301 through shared solvent line 303. The liquid water coats the channels of the mixing area 304 in step 401 and is further dispensed through mixing area 304 to the mixing chamber to coat the basin 307 in step 401. An alcoholic solvent is then flowed from a third reservoir 315 through the shared solvent line 303 to the mixing area to sanitize the mixing area. Step 202 is then conducted to dispense ingredients from the ingredient reservoirs, such as ingredient reservoir 305, into mixing area 304 to form an intermediate mixture. Step 203 is then conducted to dispense the intermediate mixture into the mixing chamber. Subsequently or simultaneously, a sweetener solvent is dispensed in a step 209 from a second reservoir 312 to the basin 307 using a dedicated sweetener line 313. The final beverage can then be dispensed out of the device in 204. However, prior to that, a rinsing step 404 can be conducted using water which flows from the first reservoir 301 through the mixing area 304 to rinse it out and additionally rinses out basin 307. However, the rinsing of the mixing chamber can also be done using a flow of water directly from the reservoir or using carbonated water if the beverage is a carbonated drink. As such, the flow chart also includes a step 207 of flowing a mixed solvent to the mixing chamber. This step could involve dispensing carbonated water from carbonated water reservoir 310 using dedicated line 311. Multiple variations to this sequence are possible based on the characteristics of the beverage and the beverage mixture system as will be apparent form a review of the above disclosure.

A controller, as used in this disclosure, can include one or more processors that can be distributed locally within the system or remotely. For example, one or more components of the system, such as valves, pumps, and sensors can be associated to individual microcontrollers that can control their operations and interaction with other components of the system. In specific embodiments of the invention, the controller can be a control system for the overall device even if the various control elements are separately programmed and are not part of a common control hierarchy. The controller can have access to one or more memories that store the instructions for the controllers to execute any of the methods disclosed herein. The memories can also store information for the system, such as a library of recipes, reference values such as the amount of solvents or other compounds to flow through the system and which fluid paths to utilize, and any other necessary information such as sensor data and the like.

While the specification has been described in detail with respect to specific embodiments of the invention, it will be appreciated that those skilled in the art, upon attaining an understanding of the foregoing, may readily conceive of alterations to, variations of, and equivalents to these embodiments. Any of the method disclosed herein can be executed by a processor in combination with a computer readable media storing instructions for the methods in combination with the other hardware elements described above. These and other modifications and variations to the present invention may be practiced by those skilled in the art, without departing from the scope of the present invention, which is more particularly set forth in the appended claims.

What is claimed is:

1. A method of operating a beverage mixture dispensing system comprising a first reservoir containing a first solvent, a set of at least two ingredient reservoirs containing concentrated ingredients, a set of valves, a mixing area fluidly connected to the first reservoir, the set of at least two ingredient reservoirs, and an outlet valve, a mixing chamber fluidly connected to the mixing area via a fluid inlet and the outlet valve, and having (i) a sealable outlet and (ii) a basin, a first solvent line, a first pump, a second reservoir containing a sweetening liquid, a dedicated sweetener line, a second pump, a set of orifices having an orifice for each of the ingredient reservoirs in the set of at least two ingredient reservoirs, wherein each orifice in the set of orifices has a diameter of less than 5 millimeters, and a controller storing instructions, wherein each method step is conducted by the controller executing the stored instructions, the method comprising:

flowing, using the first pump and the first solvent line, the first solvent from the first reservoir to the mixing area;

dispensing, using the set of valves and the set of orifices, the concentrated ingredients into the mixing area to combine the first solvent from the first reservoir with the concentrated ingredients to form an intermediate mixture;

flowing, using the outlet valve and the fluid inlet, the intermediate mixture to the mixing chamber and into the basin;

flowing, using the second pump and the dedicated sweetener line, the sweetening liquid from the second reservoir to the mixing chamber, without flowing the sweetening liquid through the mixing area, to combine the sweetening liquid from the second reservoir with the intermediate mixture to form a beverage; and dispensing, using the sealable outlet, the beverage from the mixing chamber.

2. The method of claim 1, further comprising:

coating, using the first pump, and before the flowing of the sweetening liquid from the second reservoir to the mixing chamber, a portion of the basin of the mixing chamber with the first solvent from the first reservoir; and wherein, during the flowing of the sweetening liquid from the second reservoir to the mixing chamber, the sweetening liquid from the second reservoir only touches the basin at the portion of the basin.

3. The method of claim 1, further comprising:

flowing, using a third pump of the beverage mixture dispensing system, an alcoholic solvent from a third reservoir of the beverage mixture dispensing system to the mixing area; and wherein the flowing of the first solvent from the first reservoir to the mixing area is conducted both before and after the flowing of the alcoholic solvent from the third reservoir to the mixing area.

4. The method of claim 3, wherein:

the flowing of the alcoholic solvent from the third reservoir to the mixing area of the beverage mixture dispensing system sanitizes the mixing area.

5. The method of claim 3, further comprising:

coating, using the first pump, and before the flowing of the sweetening liquid from the second reservoir to the mixing chamber and before the flowing of the alcoholic solvent from the third reservoir to the mixing area, the mixing chamber with the first solvent from the first reservoir; and rinsing, using the first pump, and after the dispensing of the concentrated ingredients into the mixing area, the mixing area with the first solvent from the first reservoir.

6. The method of claim 5, wherein:

the combined amount of the first solvent used in the coating step and the rinsing step is equal to a quantity of the first solvent in the beverage.

7. The method of claim 1, further comprising:

flowing, using a third pump, an alcoholic solvent from a third reservoir to the mixing area of the beverage mixture dispensing system;

coating, using the first pump, and before the flowing of the sweetening liquid from the second reservoir to the mixing chamber and before the flowing of the alcoholic solvent from the third reservoir to the mixing area, the mixing area with the first solvent from the first reservoir; and coating, using the first pump, and before the flowing of the sweetening liquid from the second reservoir to the mixing chamber, a portion of the basin of the mixing chamber with the first solvent from the first reservoir; and wherein, during the flowing of the sweetening liquid from the second reservoir to the mixing chamber, the sweetening liquid from the second reservoir only touches the basin at the portion of the basin.

8. The method of claim 7, wherein:

the coating of the mixing area and the coating of the portion of the basin are both conducted prior to the dispensing of the concentrated ingredients.

9. The method of claim 7, wherein:

the coating of the mixing area is conducted prior to the dispensing of the concentrated ingredients; and the coating of the portion of the basin is conducted using the intermediate mixture.

10. The method of claim 1, further comprising:

carbonating, using a carbon dioxide tank of the beverage mixture dispensing system, the first solvent from the first reservoir, wherein the first solvent is water;

storing the carbonated water in a carbonated water reservoir of the beverage mixture dispensing system; and flowing the carbonated water from the carbonated water reservoir to the mixing chamber, without flowing the carbonated water to the mixing area, to combine the carbonated water from the carbonated water reservoir with the intermediate mixture to form the beverage.

11. A beverage mixture dispensing system comprising:

a first reservoir containing a first solvent;

a set of at least two ingredient reservoirs containing concentrated ingredients;

a set of valves;

a mixing area fluidly connected to the first reservoir, the set of at least two ingredient reservoirs, and an outlet valve;

a mixing chamber fluidly connected to the mixing area via a fluid inlet and the outlet valve, and having (i) a sealable outlet and (ii) a basin;

a first solvent line;

a first pump;

a second reservoir containing a sweetening liquid;

a dedicated sweetener line;

a second pump;

a set of orifices having an orifice for each of the ingredient reservoirs in the set of at least two ingredient reservoirs, wherein each orifice in the set of orifices has a diameter of less than 5 millimeters; and a controller storing instructions which, when executed by the controller, cause the beverage mixture dispensing system to:

flow, using the first pump and the first solvent line, the first solvent from the first reservoir to the mixing area of the beverage mixture dispensing system;

dispense, using the set of valves and the set of orifices, the concentrated ingredients into the mixing area to combine the first solvent from the first reservoir with the concentrated ingredients to form an intermediate mixture;

flow, using the outlet valve and the fluid inlet, the intermediate mixture to the mixing chamber and into the basin;

flow, using the second pump and the dedicated sweetener line, the sweetening liquid from the second reservoir to the mixing chamber, without flowing the sweetening liquid through the mixing area, to combine the sweetening liquid from the second reservoir with the intermediate mixture to form a beverage; and dispense, using the sealable outlet, the beverage from the mixing chamber.

12. The beverage mixture dispensing system of claim 11, wherein:

the controller further stores instructions which, when executed by the controller, cause the beverage mixture dispensing system to coat, using the first pump, and before the flowing of the sweetening liquid from the second reservoir to the mixing chamber, a portion of the basin with the first solvent from the first reservoir; and during the flowing of the sweetening liquid from the second reservoir to the mixing chamber, the sweetening liquid from the second reservoir only touches the basin at the portion of the basin.

13. The beverage mixture dispensing system of claim 11, further comprising:

a third reservoir containing an alcoholic solvent; and a third pump; and wherein the controller further stores instructions which, when executed by the controller, cause the beverage mixture dispensing system to flow, using the third pump, the alcoholic solvent from the third reservoir to the mixing area of the beverage mixture dispensing system; and wherein the flowing of the first solvent from the first reservoir to the mixing area is conducted both before and after the flowing of the alcoholic solvent from the third reservoir to the mixing area.

14. The beverage mixture dispensing system of claim 13, wherein:

the flowing of the alcoholic solvent from the third reservoir to the mixing area of the beverage mixture dispensing system sanitizes the mixing area.

15. The beverage mixture dispensing system of claim 13, wherein the controller further stores instructions which, when executed by the controller, cause the beverage mixture dispensing system to:

coat, using the first pump, and before the flowing of the sweetening liquid from the second reservoir to the mixing chamber and before the flowing of the alcoholic solvent from the third reservoir to the mixing area, the mixing chamber with the first solvent from the first reservoir; and rinse, using the first pump, and after the dispensing of the concentrated ingredients into the mixing area, the mixing area with the first solvent from the first reservoir.

16. The beverage mixture dispensing system of claim 15, wherein:

the combined amount of the first solvent used to coat the mixing chamber and to rinse the mixing area is equal to a quantity of the first solvent in the beverage.

17. The beverage mixture dispensing system of claim 11, wherein:

the controller further stores instructions which, when executed by the controller, cause the beverage mixture dispensing system to:

flow, using a third pump, an alcoholic solvent from a third reservoir to the mixing area of the beverage mixture dispensing system;

coat, using the first pump, and before the flowing of the sweetening liquid from the second reservoir to the mixing chamber and before the flowing of the alcoholic solvent from the third reservoir to the mixing area, the mixing area with the first solvent from the first reservoir; and coat, using the first pump, and before the flowing of the sweetening liquid from the second reservoir to the mixing chamber, a portion of the basin of the mixing chamber with the first solvent from the first reservoir; and during the flowing of the sweetening liquid from the second reservoir to the mixing chamber, the sweetening liquid from the second reservoir only touches the basin at the portion of the basin.

18. The beverage mixture dispensing system of claim 17, wherein:

the coating of the mixing area and the coating of the portion of the basin are both conducted prior to the dispensing of the concentrated ingredients.

19. The beverage mixture dispensing system of claim 17, wherein:

the coating of the mixing area is conducted prior to the dispensing of the concentrated ingredients; and the coating of the portion of the basin is conducted using the intermediate mixture.

20. The beverage mixture dispensing system of claim 11, further comprising:

a carbon dioxide tank; and a carbonated water reservoir;

wherein the controller further stores instructions which, when executed by the controller, cause the beverage mixture dispensing system to:

carbonate, using the carbon dioxide tank, the first solvent from the first reservoir, wherein the first solvent is water;

store the carbonated water in the carbonated water reservoir; and flow the carbonated water from the carbonated water reservoir to the mixing chamber, without flowing the carbonated water to the mixing area, to combine the carbonated water from the carbonated water reservoir with the intermediate mixture to form the beverage.

* * * * *